US012479541B2

(12) United States Patent
Mendez Zarate

(10) Patent No.: US 12,479,541 B2
(45) Date of Patent: Nov. 25, 2025

(54) DYNAMIC FIN ALIGNMENT SYSTEM

(71) Applicant: Yuri Mendez Zarate, Ottawa (CA)

(72) Inventor: Yuri Mendez Zarate, Ottawa (CA)

( * ) Notice: Subject to any disclaimer, the term of this patent is extended or adjusted under 35 U.S.C. 154(b) by 471 days.

(21) Appl. No.: 18/014,336

(22) PCT Filed: Dec. 18, 2020

(86) PCT No.: PCT/CA2020/051751
§ 371 (c)(1),
(2) Date: Jan. 3, 2023

(87) PCT Pub. No.: WO2022/126226
PCT Pub. Date: Jun. 23, 2022

(65) Prior Publication Data

US 2023/0303222 A1 Sep. 28, 2023

(51) Int. Cl.

| | |
|---|---|
| ***B63B 32/64*** | (2020.01) |
| ***B63B 1/24*** | (2020.01) |
| ***B63B 1/28*** | (2006.01) |
| ***B63B 32/66*** | (2020.01) |

(52) U.S. Cl.
CPC ..... *B63B 32/64* (2020.02); *B63B 1/242* (2013.01); *B63B 1/283* (2013.01); *B63B 1/285* (2013.01); *B63B 32/66* (2020.02)

(58) Field of Classification Search
CPC ..... B63B 32/60; B63B 32/64; B63B 32/66; B63B 1/242; B63B 1/283; B63B 1/285
See application file for complete search history.

(56) References Cited

U.S. PATENT DOCUMENTS

| | | | | |
|---|---|---|---|---|
| 6,053,789 | A | 4/2000 | Miyashiro | |
| 6,213,044 | B1 | 4/2001 | Rodgers et al. | |
| 6,439,940 | B1 | 8/2002 | Pouchkarev | |
| 7,108,571 | B2 * | 9/2006 | Geraghty | B63B 32/66 441/79 |
| 8,083,560 | B2 * | 12/2011 | Foulke | B63B 32/66 441/79 |
| 8,414,344 | B2 * | 4/2013 | Foulke | B63B 32/66 441/79 |
| 9,132,895 | B2 * | 9/2015 | Heesterman | B63B 32/64 |
| 9,561,840 | B2 * | 2/2017 | Dilling | B63B 32/64 |

(Continued)

OTHER PUBLICATIONS

EP 20965308 Search Report dated Aug. 30, 2024.

*Primary Examiner* — Ajay Vasudeva
(74) *Attorney, Agent, or Firm* — Teitelbaum & Bouevitch; Neil Teitelbaum

(57) ABSTRACT

A watercraft fin that dynamically keep a neutral alignment within the range of angles a user chooses to have and/or change in respond to the flow conditions so reducing drag. Hence, this invention is such to enable a fin to rotate within a range of angles via a rotary bearing and bearing housing which are to receive a fin having a journal base. The housing is to be fitted to a watercraft such as a surfboard, the housing having a changeable circular keyway to loosely receive a shear key at the underside of the journal base as to allow free circular motion of the shear key and correspondingly the journal base and the fin within the limits of the selected circular length of the keyway. In one form the fin is fitted with a root portion adapted to be inserted into a receiving portion extending radially in the journal base and trapped within the bore of the bearing.

8 Claims, 4 Drawing Sheets

(56) References Cited

U.S. PATENT DOCUMENTS

| | | | | |
|---|---|---|---|---|
| 9,896,168 | B1 | 2/2018 | Lindbergh | |
| 2004/0235374 | A1 | 11/2004 | Garcia | |
| 2004/0242093 | A1 | 12/2004 | Geraghty | |
| 2016/0288883 | A1* | 10/2016 | Edmonston | B63B 32/64 |

* cited by examiner

DYNAMIC FIN ALIGNMENT SYSTEM

RELATED APPLICATION DATA

This application is the national stage entry of International Appl. No. PCT/CA2020/051751, filed Dec. 18, 2020. All claims of priority to that application are hereby made, and that application is hereby incorporated in its entirety by reference.

FIELD OF THE INVENTION

This invention generally relates to the operational mechanics of fins that are attached to watercraft for control. Specifically, this invention relates to mechanical means to implement removable fins that enable better application of their operational mechanics and more specifically, it relates to means to implement dynamically a better alignment of fins to reduce drag, enable thrust and maintain control.

BACKGROUND OF THE INVENTION

Conventional surfboard fins are installed aiming forward towards the front end. They are installed in a symmetrical arrangement with respect to the center line. The preferred arrangement nowadays include three fins. When the arrangement of fins include a fin at the center, the center fin is generally installed closest to the rear end and aligned exactly with the center line while the reminder fins are placed further ahead symmetrically from the center fin. There are two angles in connection with fins that are installed symmetrically away from the centerline. One that measures the alignment of the fin on a plane that contains the surfboard and one that measures the angle of the plane containing the fin with respect to the plane containing the surfboard. The former, here referred to as the toe angle, in its nowadays preferred arrangement aligns the angle of attack of the fins in a direction that is inclined slightly inward towards the center line, the latter, here referred to as the tilt angle, tilts the fin slightly outward away from the center line and is measured as a deviation from the 90 degree position, generally about 4 degrees.

The development of surfboard design and surfboard fins for the subject matter has been by trial and error along with the availability of new materials and technologies. The angle and alignment of fins mentioned above is thus the result of that process. Notably, three fins surfboards, since their first introduction in 1981 by Simon Anderson implemented both angles in approximately the same arrangements as used today. It thus appeared intuitively logical at the time and they appear logical at this time. Generally surfboard shapers use preferred angles and in some very rare cases, surfboard riders request their preferred angles in deviations of no more than a few degrees.

Fins, as installed on surfboards satisfy intuition by way of the connection with live creatures such as sharks and dolphins, however, wave riding is unique. No creature has ever evolved to permanently navigate sideways an incoming flow as surfboards do. Planing on a horizontal plane between water and air is also unique to surface watercraft.

Fins can be fixed to the surfboard permanently or be fixed by way of a built in attachment system commonly referred to as fin box. Generally, most previous art involve the development of unique means to attach the fin to the surfboard without any adjustment of the angles which are set in the box or the fin itself during construction of the surfboard such as those in U.S. Pat. No. 8,465,334 to Hort et al. and U.S. Pat. No. 6,695,662 to Kelley as illustrative examples. In some instances the toe angle is adjusted by no more than a few degrees and the fin is fixed at that angle without ability to change during wave riding such as those in U. S. Pre-Grant Pub. No. 2006/0035543 to English and Belitz and U.S. Pat. No. 5,567,190 to Oates as illustrative examples of those instances. In other instances the tilt angle of the fin can be adjusted such as those in U. S. Pre-Grant Pub. No. 2004/0248482 to Larkin and U. S. Pre-Grant Pub. No. 2004/0235374 to Garcia as illustrative examples. U.S. Pat. No. 6,439,940 to Pouchkarev describes inner workings of movable fins with a functionality that involves at least one pair of non removable fins and the watercraft itself. U. S. Pre-Grant Pub. No. 2016/0090169 to Jean Francois Iglesias have sought to provide flexibility to the fins for variation of their angle of attack.

The preferred approach nowadays is removable fins in fixed angles via a fin box. Removable fins incorporate numerous sought advantages such as ease of transport and the ability to use different fins for different wave conditions.

The direction of travel of surfboards is in general sideways with respect to the direction of the motion of waves. The surfboard is always planing or gliding sideways to counteract forces that are pushing it towards the direction of the wave, however surfboards can still glide sideways without fins. The fins increase maneuverability and control.

Directional fins, such as those on surfboards are installed to reduced drag to the minimum by having their angle of attack in the same direction of the motion. Small variations of their angle with respect to the incoming flow induce forces that attempt to re-align the fins with the flow so changing the direction of the water craft they are attached to. As surfboards are almost permanently gliding sideways, the alignment of the fins should be such to nearly match the direction of the glide to reduce drag.

Maneuvers in surfing consist on turns that are at least 90 degrees and most often 180 degrees. This is because the surfer is at all times avoiding to glide straight down the direction of the wave, except when it is strictly necessary or when is forced to do so by the section he is navigating. In a situation in which the surfer is gliding straight down the maneuver sought is at least 90 degrees to engage the face of the wave for what he turns the nose sharply to approach the 90 degrees angle with respect to the direction of the wave thus achieving the sought glide sideways as the wave lift the surfboard along the rail and continue to advance.

In doing the 90 degrees turn to reach the sough direction, the angle of attack of the fins is slanted sharply almost the same 90 degrees, sideways against the incoming flow so inducing excessive drag in the original direction rather than a smooth transition without loosing speed. The slant angle is always excessive for the maneuvers sought when turning the board.

To reduce the slant angle with respect to flow sideways beneath the surfboard, the slant angle needs to be reduced to reduce drag and enable smooth tran-sitions. For a surfboard riding the face of the wave to the right side of the wave by effectively aiming a direction that is approximately 45 degrees to the right with respect to the direction of the wave, vector analysis indicate that the resulting flow velocity is to the rear-right of the surfboard some rear-10 degrees-right (Re10Ri) to Re20Ri with respect to the direction of the center line of the surfboard. Vector analysis indicate that this angle is greater for greater suction velocities, the suction velocity being the velocity at which the wave drains water from its base to pitch it about its crest which is notoriously high in some waves such as those in Teahupoo, Tahiti or Skeleton Bay in Namibia.

Surfboards will plane to the right or left without fins and do so in virtue of their shape. A permanent slant angle will be a slight deviation from its neutral, in the case at hand a deviation from the Re10Ri to Re20Ri neutral position, tail wise for all fins. In the case at hand, when the surfboard is planing down to the right of the wave (roughly aligned at some 45 degrees to the right), maneuvers are accomplished by turning the surfboard to the left or right from that 45 degrees direction. When the surfboard is turned to the left of that direction, it is planing down the face of the wave for which the fins are not needed so that are better aligned in a neutral direction with its angle of attack aligned with the incoming flow, whereas planing up the face is by turning the surfboard to the right for which the fins at an adequate slant angle with respect to the incoming sideways flow, are needed for greater responsiveness but yet minimize drag to keep the speed. Angles as high as 45 degrees to the right and left appear to meet mechanics for forward thrust when some conditions are met.

It can be seen that fins that are attached on fixed positions lack recognition of the unique dynamics of the sideways flow velocity beneath surfboards and watercraft relying greatly on their shape for direction. As such fins that are aligned exactly or very close to the direction the centerline aims, as in all prior art, induce unnecessary drag because their angle of attack is excessively slanted or outright side-ways with respect to the motion of the surfboard. While a degree of a slanted angle must be relied upon by the surfer, the optimum angle reducing the drag to the maximum and maintaining the desire responsiveness will require finer tunning than any available system can provide. On the other hand because of the fact that the center fin cannot be adjusted in any system the problem of the excessively slanted angle of attack is always present.

While the ability of fins to remain neutral is seen to be advantageous for the dynamics of wave riding, it is also useful for water craft in general, specially for those that greatly rely on their shape for direction.

What is needed is removable surfboard fins for which the trailing edge can swing to some degree about an axis near the leading edge of the fin thus enabling a degree of freedom of fin engagement. The degrees of freedom of fin engagement need to be such to allow the fin to naturally keep a neutral position when gliding down the face and a near neutral position when gliding left or right down the face of the wave. The neutral position being that in which the angle of attack of the fin is aligned exactly opposite to the flow velocity vector. The magnitude of the swing should be changeable and such to reach a stop position that approach the direction of the sideways flow but is slightly slanted to permit adequate response to the commanding inputs from the operator of the craft or the surfer. The system should be such to allow ease of change of the angle of freedom, easy installation of the fin on the surfboard, easy maintenance and ease on changing fin types for different wave conditions.

It would be advantageous to provide a system that overcomes at least some of the drawbacks of the prior art.

SUMMARY OF THE INVENTION

It is the object of this invention to reduce shortcomings and deficiencies of fins installed and/or enabled for operation in fixed directions by:

(a) Enabling water craft fins that can partially rotate so implementing a degree of freedom of fin engagement and that are as well easy to remove and change.

(b) Enabling an engagement angle of the fin(s) that dynamically change left or right maintaining a direction that is slanted slightly with respect to the flow velocity vector when the watercraft planes left or right along the face of a wave to minimize drag and provide adequate responsiveness.

(c) Providing means to enable surfers to discover the best operational angle of fins that adapts best to different waves, different wave sizes or different surfer styles.

(d) Enable fin alignments that will assist in elucidating insights regarding the functionality of fins which will further advance watercraft design.

To meet the objects of this invention, the operational principles of fins are implemented via the inner workings and components of rotary bearings.

Correspondingly, the present invention sets out to provide an assembly of parts for a rotary bearing to enable a fin having a journal base or to which fins can be attached, enabled to freely or partially rotate upon the action of fluid forces that naturally act on water crafts. In the key aspect of partial rotation of fins in this invention, the magnitude of the angle of free partial rotation can be set or disabled via changeable inserts. Fin directions can also be set at fixed angles via changeable inserts so enabling any fixed alignment angle.

In accordance with an aspect of at least one embodiment, there is provided a dynamic fin alignment system comprising: a bearing housing for attachment to a watercraft, the bearing housing having a housing bore with means for releasably securing a rotary bearing, the bearing housing having an interior base surface with a recessed slot defined therein, the recessed slot configured to releasably secure a correspondingly shaped changeable insert; a rotary bearing for being releasably secured into said bearing housing and having at least one race and a bearing bore coaxial with said housing bore when the dynamic fin alignment system is in an assembled condition; an axially symmetric body having a journal for cooperating with the at least one race to support rotation of the axially symmetric body relative to the rotary bearing; a fin extending from a first side of the axially symmetric body when the dynamic fin alignment system is in the assembled condition; a shear key extending from a second side of the axially symmetric body that is opposite the first side; and a plurality of said changeable inserts for being disposed, one at a time, within the recessed slot of the bearing housing, each changeable insert having a keyway for receiving the shear key when the dynamic fin alignment system is in the assembled condition.

In accordance with an aspect of at least one embodiment, there is provided a fin assembly comprising: a fin having a root body; a rotary bearing securable to a bearing housing, the rotary bearing having a bearing surface defining at least one race and the rotary bearing having a bearing bore; and a rotatable, axially symmetric disk base having a journal portion for cooperating with the at least one race to support rotation of the axially symmetric body relative to the rotary bearing, and having a slot extending across a width of the axially symmetric disk base for slidingly receiving the root body therein to secure the fin to the axially symmetric disk base.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
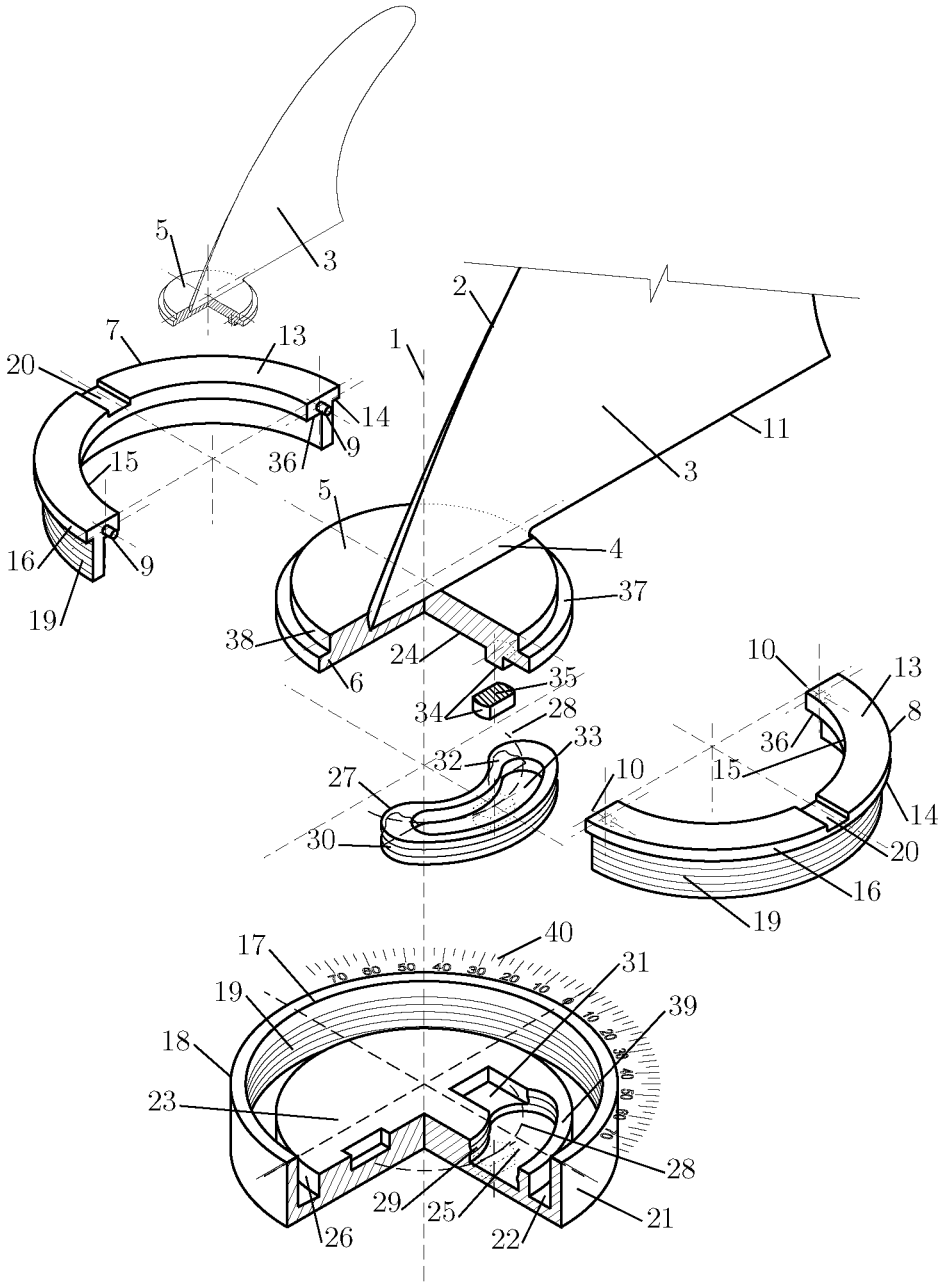
FIG. 1 is an exploded-view drawing of a fin having a journal base, a two piece bearing, a bearing housing and an insert having a selected keyway length accordingly to meet the objects of this invention.

The exploded-view drawing in FIG. 1 shows an exemplary arrangement of a preferred embodiment of this invention for crafts that are laminated with fiber glass. In FIG. 1 one sees an axis of rotation [1] oriented top to bottom located near the foremost portion of the leading edge [2] of the fin [3] around which the fin [3] is to rotate.

The bottom front end [4] of the fin is in material connection with a body having the geometry of a stack of two coaxial disks which are in turn coaxial with the axis of rotation [1], a disk base [5] with a disk journal [6] at its underside which are to bear in a bearing comprising a first piece [7] and a second piece [8] fitted with alignment pins [9] and receiver holes [10] or the like to accurately align its first piece [7] and its second piece [8] together, the trailing portion of the fin's bottom end [11] extending closely and parallel to the under-side of the watercraft (not shown). The view of the entire fin [3] and its disk base [5] are also shown in smaller scale on the top left side of FIG. 1.

The bearing ([7] and [8]), has an exterior side face [13] and an underside face [14] that extend radially from its bore [15] to an outer rim [16] dimensionally fit to meet the bore [17] of a bearing housing [18], the bearing's underside face [14] having means to be releasably secured to the bore [17] of the bearing housing [18] which in this embodiment consists of a thread connection [19] drivable with a hard edge on notches [20], the exterior side face [13] of the bearing flush with the lami-nation finish (not shown).

The bearing housing [18] forms a coaxial cylindrical hull at the underside of the lamination (not shown) of the watercraft with its bore [17] facing upward to receive the bearing ([7] and [8]) and having exterior side faces [21] and interior side faces [22], the exterior side [21] may have a framework to facilitate interlocking engagement thereof with an adhesive material for affixing the fin box to the watercraft, which in this embodiment consists on its exterior side faces [21], the bearing housing's [18] interior side face facing upward [22] having a cir-cular protrusion [23] dimensionally fit to meet the underside of the disk journal [24] and having an elongated circular slot [25] between its axis [1] and its rim [26] shaped to receive a correspondingly shaped insert [27], the slot being axisymmetric about a circular axis [28] at its center which is concentric with the axis of rotation [1], the slot extending circularly along the circular axis [28] a finite distance and having means to releasably secure the correspondingly shaped insert [27], which in this embodiment consists of a protrusion [29] along the slot's side walls to engage a correspondingly shaped cavity [30] when the insert [27] is pressed into the circular slot [25] which may extend into means to facilitate removal, which in this embodiment consists of notches [31] to manually exert a prying force to a slanted undercut [32] on the insert [27] for removal.

The insert [27] having an elongated circular keyway [33] axisymmetric about the circular axis [28] of the circular slot [25], the keyway [33] being dimen-sionally fit to radially and circularly loosely receive a shear key [34] correspondingly protruding from the underside of the disk journal [24] into the center of the keyway [33].

The shear key [34] being preferably in cross section of a circular segment [35] shape to withstand the lateral force induced by rotational forces acting upon the fin and when moving side to side and allowing the movement of water from side to side to prevent the build up of pressure. Another preferred embodiment of the shear key may radially fit tight within the keyway allowing the build up of pressure for a slow transition between the initial time of the turn and the final position of the fin at the stop point in the insert.

The arrangement in FIG. 1 is dimensionally and structurally fitted to bear loads allowing free rotation within the limits of the difference in length between the keyway [33] and the shear key [34]. Axially outward loads are bear along the race [36] at the underside of the bearing normally adjacent to the bore [15] of the bearing, the journal being the upper side [37] of the disk journal adjacent to the rim [38] of the disk base [5]. Radial loads are bear along the bore [15] of the bearing, the journal being the rim [38] of the disk base [5]. Axially inward loads are preferably bear along the circular protrusion [23] in the bearing housing [18], along the edge normally adjacent [39] to its rim [26].

The exemplary embodiment in FIG. 1 also includes an in-lamination pro tractor [40] image preferably in the trailing side of the bearing housing to obtain information visually about the current alignment and range.

Figure 2:
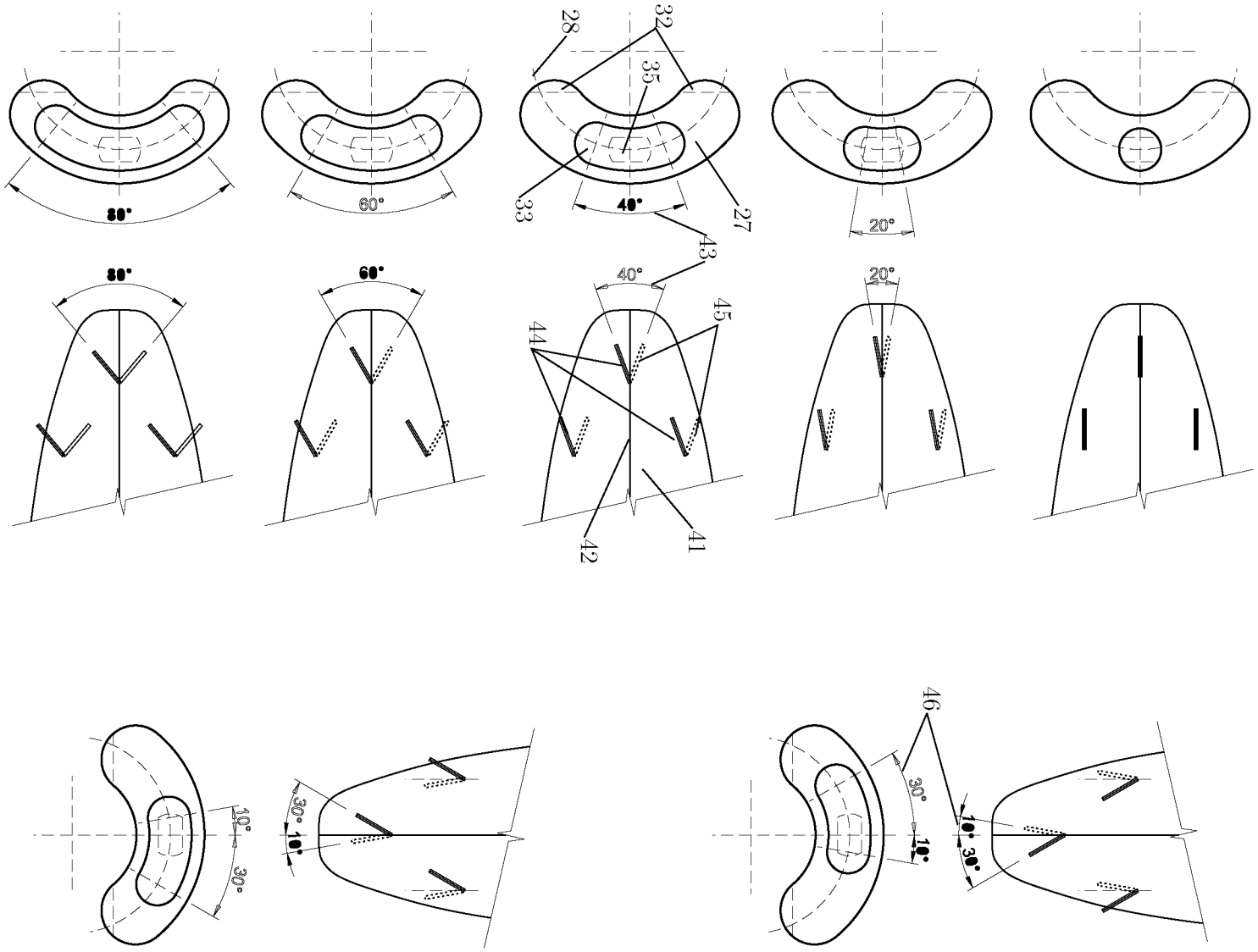
FIG. 2 is an exemplary set of inserts to enable numerous degrees of freedom of fin engagement in support of the embodiment in FIG. 1 to meet the objects of this invention.

FIG. 2 shows an exemplary set of inserts for different degrees of freedom of fin engagement and their effect on fin alignment. In FIG. 2 one sees the underside [41] rear portion of a surfboard, its center line [42] and its nowadays preferred arrangement of three fins, free to rotate symmetrically the angle of freedom [43] enabled by three identical inserts [27] from a first position [44] to a second position [45].

The angle of freedom [43] of fins enabled on the surfboard by other sets of three inserts is shown above, below and to the right in the figure. It can be seen on the right side of FIG. 2 that the inserts can enable asymmetric [46] alignment which may be preferred to enable stalls for tube riding or to cut back into preferred sections for waves that are exclusively to the right or to the left. FIG. 2 also shows the slanted undercut [32] for prying out the insert [27], for the ease of reference a dotted perimeter of the circular segment [35] cross section of the shear key [34] as it sits in the keyway [33] when deployed is also seen along with the circular axis [28] in which the keyway [33] extends and the shear key [34] moves.

The set of inserts in FIG. 2 includes a labeling scheme to refer to the angles set by the insert, in said scheme the water craft is referred to as having a deck, an underside, a center line, a frond end and a rear end in a conventional manner and a user refers to the alignment of the fins and the craft as standing on its deck looking towards the front. Said scheme consists on letters and numbers as described below and not shown in FIG. 2.

The alignment or range of alignments of one fin set by an insert is given on the trailing side in reference to a line parallel to the center line, further referred to as center line, passing through the center of rotation of the fin. The scheme can be applied to fixed fins or for fins having a degree of freedom, further referred to as freedom, for which the center line is within the range of the angles swept by the fin. The fin can be Fixed or have Symmetric or Asymmetric sweep, Left or Right correspondingly denoted in the scheme using the letters F, S, A, L and R. The term "Simon Anderson" (SA) is applicable for fixed alignments defined with a single toe angle in its nowadays preferred range of 3 to 5 degrees. A slash/is used as a separator and a prefix in the form of yx denoting the number of fins y on the surfboard when required.

The order of the letters and numbers in the following order: 3×A20L/10R for 3 fins having 20+10=30 degrees freedom, asymmetric sweep, 20 degrees left and 10 to the right. Correspondingly, a symmetric 30 degrees freedom insert is labeled S30, a 30 degrees fixed to the left fin is labeled F 30L as examples. SA4 in the scheme denotes intrinsically 3 inserts to fix 3 fins with angles correspondingly to meet the known arrangement of fins having a 4 degrees toe angle.

Figure 3:
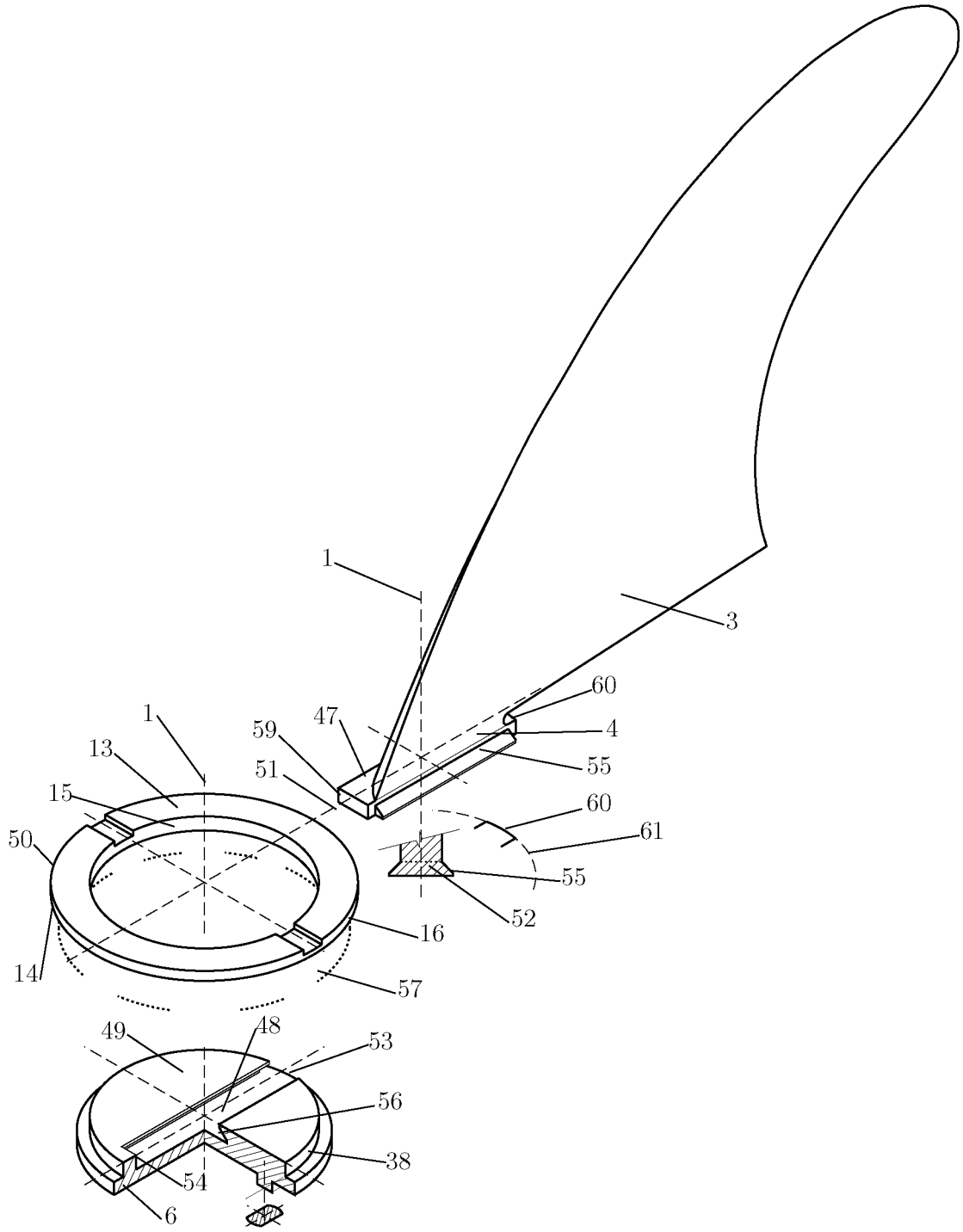
FIG. 3 is an exemplary exploded-view of a fin having a root body to be inserted into a fin base which are to be secured within the confines of the bore of a bearing.

FIG. 3 shows an alternative embodiment in which the fin [3] has a root section [47] meant to slide into a mating slot [48] extending radially within the substantial extent of a rotating disk base [49] which is to bear in a bearing [50]. In FIG. 3 one sees the fin's axis of rotation [1] and a leading-trailing axis [51] perpendicularly intersecting the axis of rotation [1] at the bottom front end [4] of the fin. The root section [47] is an elongated prism parallel to the leading-trailing axis [51] having cross section in the shape of a symmetric trapezoid [52] which is to be received within a correspondingly shaped mating slot [48] extending radially between an open end [53] on the rim [38] of the disk base [49] and a stop [54] surface near the opposite side of the rim as to have the wider side [55] of the trapezoidal cross section [52] of the root section [47] engage the material between the narrower and wider sides [56] of the trapezoidal mating slot [48]. The disk base [49] has at its underside the disk journal [6], both coaxial with the axis of rotation [1] which are to bear in the bearing [50], the bearing [50] having an exterior side face [13] and an underside face [14] that extend radially from its bore [15] to an outer rim [16] dimensionally fit to meet the bore [17] of a bearing housing [18], the bearing's underside face having means [57] to be releasably secured to the bore [17] of the bearing housing [18], the exterior side face [13] of the bearing flush with the lamination finish (not shown).

Figure 4:
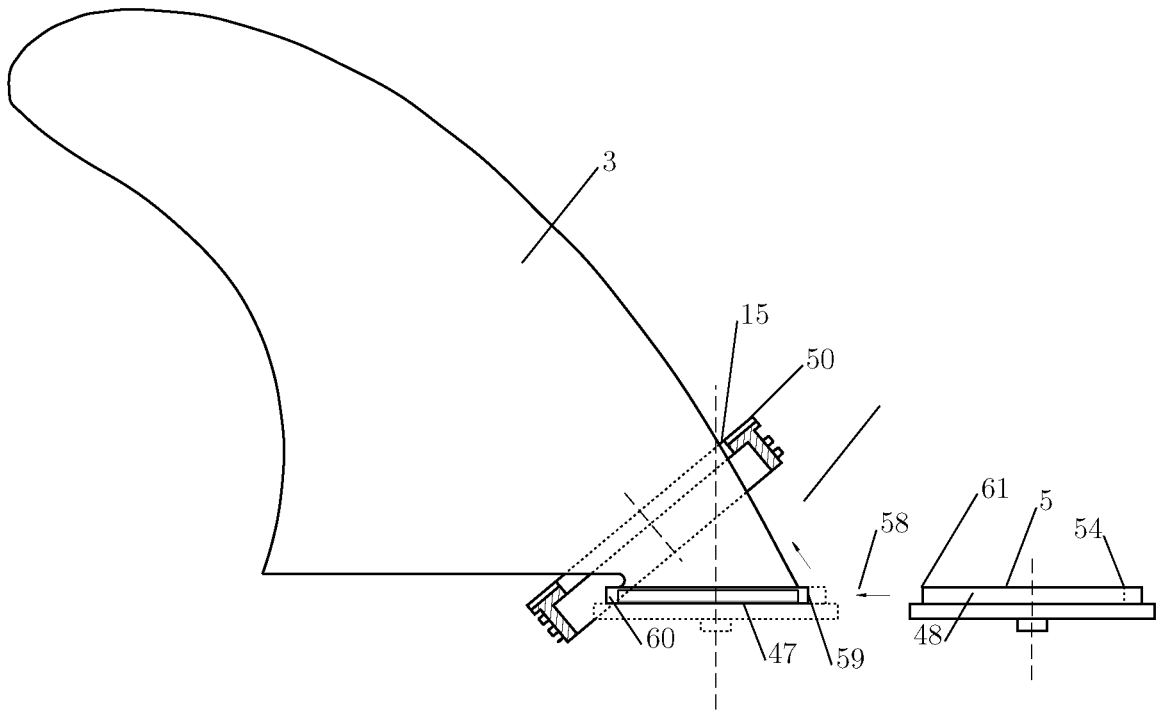
FIG. 4 illustrates how the embodiment in FIG. 3 is assembled for deployment into the bore of a bearing.

In Figure FIG. 4 one sees how the root section [47] is inserted into the top of the bearing's bore [15] which is held inclined to clear the path for the sliding motion [58] to insert the root section [47] into the mating slot [48] to the stop surface [54] at the end of the slot, the root section [47] dimensionally suited to allow a fit matching the geometry of the disk base [49] so that its leading end [59] meet the stop surface [54] and the trailing end [60] of the root section [47] closes the arc [61] of the rim of the base at its open end [53] to then insert the disk base [49] with the root section [47] into the bearing's bore [15] enabling entrapment of the fin with the disk base [49], yet allowing rotation and bearing. Then attaching the bearing [50] into the housing which is fitted correspondingly with means to attach the bearing.

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed is:

1. A dynamic fin alignment system comprising:

a bearing housing for attachment to a watercraft, the bearing housing having a housing bore with means for releasably securing a rotary bearing, the bearing housing having an interior base surface with a recessed slot defined therein, the recessed slot configured to releasably secure a correspondingly shaped changeable insert;

a rotary bearing for being releasably secured into said bearing housing and having at least one race and a bearing bore coaxial with said housing bore when the dynamic fin alignment system is in an assembled condition;

an axially symmetric body having a journal for cooperating with the at least one race to support rotation of the axially symmetric body relative to the rotary bearing;

a fin extending from a first side of the axially symmetric body when the dynamic fin alignment system is in the assembled condition;

a shear key extending from a second side of the axially symmetric body that is opposite the first side; and a plurality of said changeable inserts for being disposed, one at a time, within the recessed slot of the bearing housing, each changeable insert having a keyway for receiving the shear key when the dynamic fin alignment system is in the assembled condition.

2. The dynamic fin alignment system of claim 1 wherein the rotary bearing is a rotary two-piece bearing.

3. The dynamic fin alignment system of claim 2 wherein said rotary two piece bearing has an outer rim and an exterior side face that extends radially inward from the outer rim to a central opening defining the bearing bore, the exterior side face for being flush mounted with a finished underside of the watercraft, and wherein the at least one race is provided along an underside face that is opposite the exterior side face and that is adjacent to the bearing bore.

4. The dynamic fin alignment system as defined in claim 1 wherein the keyway of each changeable insert of the plurality of said changeable inserts has a length that extends along a circle that is concentric with said housing bore when inserted in the recessed slot, such that the shear key moves along a curved path within the keyway upon rotation of the axially symmetric body relative to the rotary bearing.

5. The dynamic fin alignment system of claim 4 wherein each changeable insert has a different keyway length relative to the other changeable inserts of the plurality of said changeable inserts.

6. The dynamic fin alignment system of claim 4 wherein the length of the keyway of at least one changeable insert of the plurality of said changeable inserts is asymmetric relative to a central plane of the at least one changeable insert, the central plane normal to the curved path.

7. The dynamic fin alignment system as defined in claim 1 wherein a side surface of the fin, which is defined between a leading edge of the fin, a trailing edge of the fin, a top edge of the fin, and a bottom edge of the fin, forms a hydrodynamic foil.

8. The dynamic fin alignment system as defined in claim 7 wherein the axially symmetric body and the fin are formed as a single, monolithic component.

* * * * *